US008662608B2

(12) United States Patent
Cui et al.

(10) Patent No.: US 8,662,608 B2
(45) Date of Patent: Mar. 4, 2014

(54) HEIGHT ADJUSTING MECHANISM AND REFRIGERATOR COMPRISING THE SAME

(75) Inventors: Huailei Cui, Anhui (CN); Chengcheng Huang, Anhui (CN); Junfeng Lei, Anhui (CN)

(73) Assignees: Hefei Midea Rongshida Refrigerator Co., Ltd., Anhui (CN); Hefei Hualing Co., Ltd., Anhui (CN)

( * ) Notice: Subject to any disclaimer, the term of this patent is extended or adjusted under 35 U.S.C. 154(b) by 0 days.

(21) Appl. No.: 13/497,082

(22) PCT Filed: Sep. 5, 2011

(86) PCT No.: PCT/CN2011/079354

§ 371 (c)(1),
(2), (4) Date: Mar. 20, 2012

(87) PCT Pub. No.: WO2012/003812

PCT Pub. Date: Jan. 12, 2012

(65) Prior Publication Data

US 2012/0181912 A1 Jul. 19, 2012

(30) Foreign Application Priority Data

Jul. 7, 2010 (CN) ..... 2010 1 0219884

(51) Int. Cl.
*A47B 96/04* (2006.01)
*E05D 7/04* (2006.01)

(52) U.S. Cl.
USPC ..... 312/405; 16/244

(58) Field of Classification Search
USPC ..... 312/405; 16/239–249
See application file for complete search history.

(56) References Cited

U.S. PATENT DOCUMENTS

| | | | | |
|---|---|---|---|---|
| 2,839,778 | A * | 6/1958 | Hutchinson et al. | 16/245 |
| 3,030,655 | A * | 4/1962 | Rudnick | 16/243 |
| 5,297,458 | A * | 3/1994 | Smith et al. | 81/124.3 |
| D398,493 | S * | 9/1998 | Jones | D8/21 |
| 6,030,064 | A * | 2/2000 | Kim | 312/405 |
| 7,490,384 | B2 * | 2/2009 | Lee | 16/244 |
| 8,166,612 | B2 * | 5/2012 | Bertolini et al. | 16/244 |
| 2006/0244351 | A1 * | 11/2006 | Moon et al. | 312/405 |
| 2007/0271729 | A1 | 11/2007 | Ribolzi et al. | |
| 2009/0038117 | A1 | 2/2009 | Moon | |
| 2011/0001413 | A1 * | 1/2011 | Park | 312/405 |

FOREIGN PATENT DOCUMENTS

| | | |
|---|---|---|
| CN | 1862174 | 11/2006 |
| CN | 101375119 | 2/2009 |
| CN | 101915041 | 12/2010 |
| CN | 201794418 U | 4/2011 |
| DE | 102008047815 | 2/2010 |
| WO | 2005/090099 | 9/2005 |

* cited by examiner

*Primary Examiner* — Darnell Jayne
*Assistant Examiner* — Timothy M Ayres
(74) *Attorney, Agent, or Firm* — Morgan, Lewis & Bockius LLP

(57) ABSTRACT

A height adjusting mechanism comprises a hinge shaft, an adjusting member for driving the hinge shaft to rotate around an axis of the hinge shaft, a constraining member for constraining a movement of the adjusting member in an axial direction of the hinge shaft and a base with the constraining member fixedly connected thereto, in which the hinge shaft connected with the base can be lifted in the axial direction of the hinge shaft under the driving of the adjusting member. A refrigerator comprising the height adjusting mechanism is also provided.

5 Claims, 5 Drawing Sheets

HEIGHT ADJUSTING MECHANISM AND REFRIGERATOR COMPRISING THE SAME

CROSS-REFERENCE TO RELATED APPLICATION

The present application is a national stage of PCT International Application No. PCT/CN2011/079354, filed on Sep. 5, 2011, and claims priority to and benefits of Chinese Patent Application Ser. No. 201010219884.1, filed with the State Intellectual Property Office of P. R. China on Jul. 7, 2010, the entire contents of which are incorporated herein by reference.

FIELD

The present disclosure relates to a refrigerator, and more particularly to an improved height adjusting mechanism and a refrigerator comprising the same.

BACKGROUND

A conventional side by side combination refrigerator comprises a main body and two is doors. Either door is rotatably connected with the main body via an adjustable hinge. When the two doors are not aligned, a height of a lower door needs to be adjusted by the adjustable hinge. As shown in FIG. 1, the adjustable hinge may comprise an adjusting member 30', a hinge base 40', a hinge 50' and bolts 60'. The hinge 50' is fixed on the hinge base 40' via three bolts 60'. When the height adjusting is performed, the bolts 60' need to be loosened, then the adjusting member 30' is rotated using a conventional wrench, such as an Allen wrench, and the hinge 50' may be threadedly lifted, thus aligning the two doors. Finally, the bolts 60' are tightened accordingly. However, the adjustable hinge has the following defects.

Firstly, adjusting steps of the adjustable hinge are tedious. In addition, during the assembling process, the hinge 50' needs to be mounted on the hinge base 40', and the hinge base 40' needs to be mounted on the main body of the refrigerator, that is, two members need to be mounted, which may result in low mounting efficiency. Furthermore, in order to facilitate an adjusting of the height of the door, a waist-shaped hole (not shown) needs to be formed in the hinge base 40', which may result in poor mounting consistency of the adjustable hinge. Because the bolts 60' need to pass through the waist-shaped hole, the mounting of the entire hinge is not stable.

SUMMARY

The present disclosure is directed to solve at least one of the problems existing in the prior art.

Accordingly, a height adjusting mechanism may need to be provided, which is convenient for adjustment in addition to low cost. Further, a refrigerator comprising the same may also need to be provided.

According to an aspect of the present disclosure, a height adjusting mechanism is provided, comprising: a hinge shaft; an adjusting member for driving the hinge shaft to rotate around an axis of the hinge shaft; a constraining member for constraining a movement of the adjusting member in an axial direction of the hinge shaft; and a base with the constraining member fixedly connected thereto, in which the hinge shaft connected with the base is liftable in the axial direction of the hinge shaft under the driving of the adjusting member.

In one embodiment, the hinge shaft is threadedly connected to the base.

In one embodiment, the base comprises: a supporting base part, to which the hinge shaft is liftably connected; and a hinge base part, in which the supporting base part is detachably accommodated. The supporting base part may be threadedly fitted with the hinge shaft in advance to form an integral assembly, which is disposed on the hinge base is part. Therefore, only the hinge base part may need to be fixed, thus improving the mounting efficiency thereof. Moreover, because only the hinge base part needs to be fixed, the fixing holes may be circular holes, thus improving the mounting consistency and the overall strength of the hinge base part. Therefore, the entire strength of the mounting may be much more stable.

In one embodiment, the supporting base part and the hinge base part are integrally formed.

In one embodiment, the height adjusting mechanism further comprises: a bottom plate disposed between a bottom surface of the supporting base part and the hinge base part. The bottom plate may distribute the pressure applied to the base by the hinge shaft during the adjusting process, thus preventing the hinge shaft from directly impacting the hinge base part to damage the height adjusting mechanism.

In one embodiment, the hinge shaft comprises: a fitting shaft portion; an adjusting shaft portion connected to the fitting shaft portion which is mated with the adjusting member so as to adjust the hinge shaft; and a connecting shaft portion which is threadedly connected to the base.

In one embodiment, a center of the adjusting member is formed with an adjusting aperture which is of a polygonal shape at the center thereof, and the adjusting shaft portion has a cross section perpendicular to the axis mated with the polygonal shape, which is configured to be running fitted with the adjusting aperture.

In one embodiment, the adjusting member has a cross section perpendicular to the axis with a polygonal periphery.

In one embodiment, the peripheral surface of the adjusting member is formed with adjusting grooves which are extended in the axial direction.

In one embodiment, the supporting base part has an end facing toward the adjusting member being formed into a stepped part having a first surface and a second surface higher than the first surface in the axial direction, with the adjusting member being disposed on the first surface and the constraining member being detachably connected to the second surface and the adjusting member being disposed between the first surface and the constraining member.

In one embodiment, the height adjusting mechanism further comprises: a spacing member disposed on the constraining member, with the spacing member and the constraining member being fixed on the second surface of the supporting base portion via a fastener.

According to another aspect of the present disclosure, a refrigerator is provided, comprising: a main body with a chamber being defined therein; a door which is pivotably is connected to the main body for opening/closing the chamber; and the above mentioned height adjusting mechanism, in which the base of the height adjusting mechanism is detachably connected to the main body, and a lower end of the door is pivotably fitted with the hinge shaft of the height adjusting mechanism.

With the refrigerator according to an embodiment of the present disclosure, because the base may be fixed in advance, when the height adjusting is performed, by using the height adjusting mechanism, only the adjusting member needs to be rotated to drive the hinge shaft to ascend or descend, thus simplifying the adjusting steps and facilitating the height adjusting operation of an operator.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings in which.

DETAILED DESCRIPTION

Figure 1:
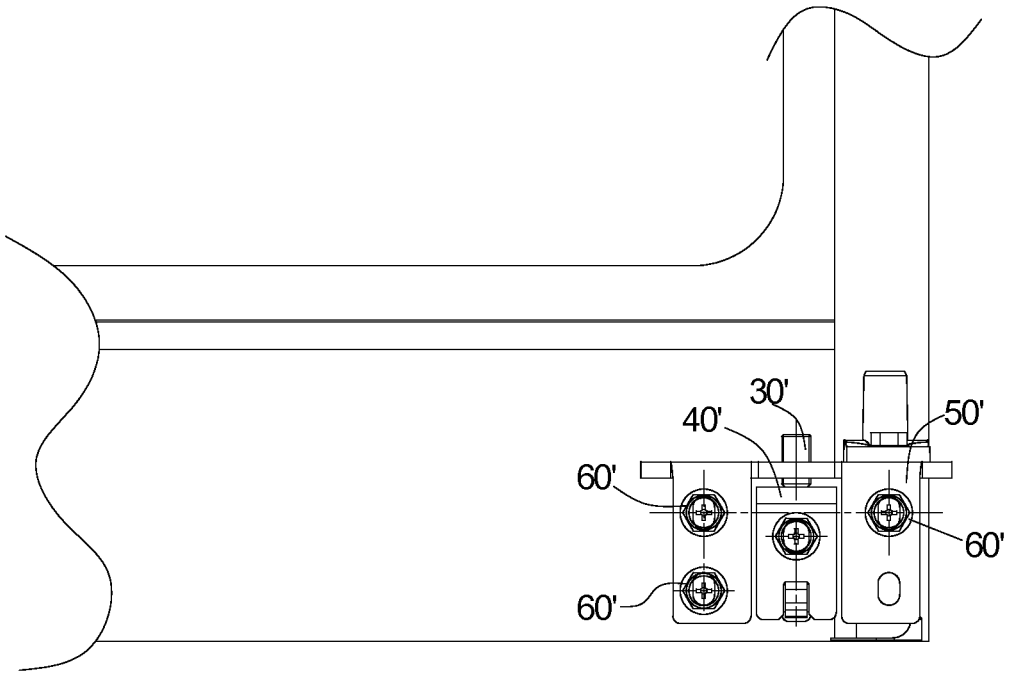
FIG. 1 is a schematic view of a refrigerator formed with an adjustable hinge in prior art.

Embodiments of the present disclosure will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present disclosure. The embodiments shall not be is construed to limit the present disclosure.

It is to be understood that terms used herein with reference to device or element orientation, such as, for example, "longitudinal", "lateral", "front", "rear", "right", "left", "lower", "upper", "horizontal", "vertical", "above", "below", "up", "top", "bottom" as well as derivative thereof such as "horizontally", "downwardly", "upwardly", etc. are only used to simplify description of the present invention, and do not alone indicate or imply that the device or element referred to must have or operated in a particular orientation. In addition, terms such as "first" and "second" are used herein for purposes of description and are not intended to indicate or imply relative importance or significance.

Figure 2:
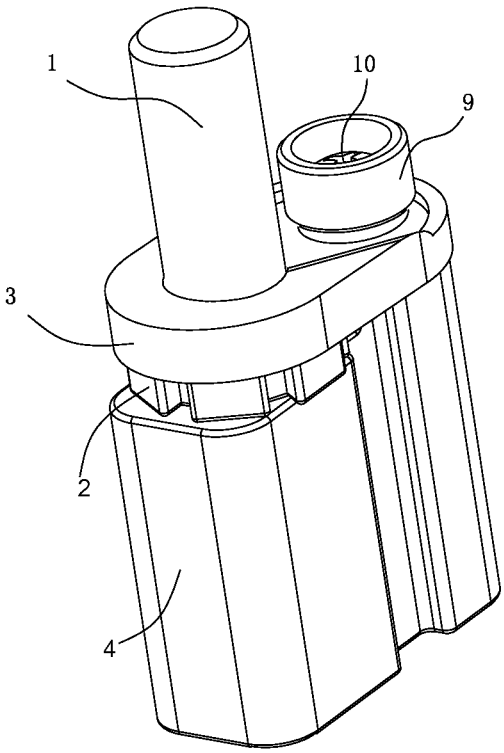
FIG. 2 is a perspective view of a height adjusting mechanism according to an embodiment of the present disclosure.

Hereinafter, a height adjusting mechanism and a refrigerator comprising the height adjusting mechanism according to an embodiment of the present disclosure will be described in detail with reference to the drawings, in which FIG. 2 is a perspective view of a height adjusting mechanism according to an embodiment of the present disclosure.

As shown in FIGS. 2-5, the height adjusting mechanism according to an embodiment of the present disclosure may comprise a hinge shaft 1 having an axis OO', an adjusting member 2, a constraining member 3 and a base 4. The hinge shaft 1 may be pivotably fitted with a support such as, for example, a refrigerator door, which may need adjustment during normal usage, such as descending or ascending somewhat in the vertical direction etc. The adjusting member 2 is connected to the hinge shaft 1 and may drive the hinge shaft 1 to rotate around the axis OO' of the hinge shaft 1. A movement of the adjusting member 2 in an axial direction of the hinge shaft 1 is constrained by the constraining member 3. The constraining member 3 is fixedly connected to the base 4, and the hinge shaft 1 connected with the base 4 is liftable in the axial direction of the hinge shaft 1 under the driving of the adjusting member 2. In other words, when the adjusting member 2 is rotated, the hinge shaft 1 rotates with the adjusting member 2, and the base 4 is stationary or fixed to a stationary member etc. Therefore, the hinge shaft 1 may be liftable, thus achieving an adjusting of a height of the support such as, for example, a refrigerator door.

In one example, an end of the hinge shaft 1 is threadedly connected to the base 4. Particularly, a lower part of the hinge shaft 1 is formed with threads so that the hinge shaft 1 may be threadedly fitted with the base 4.

Figure 3:
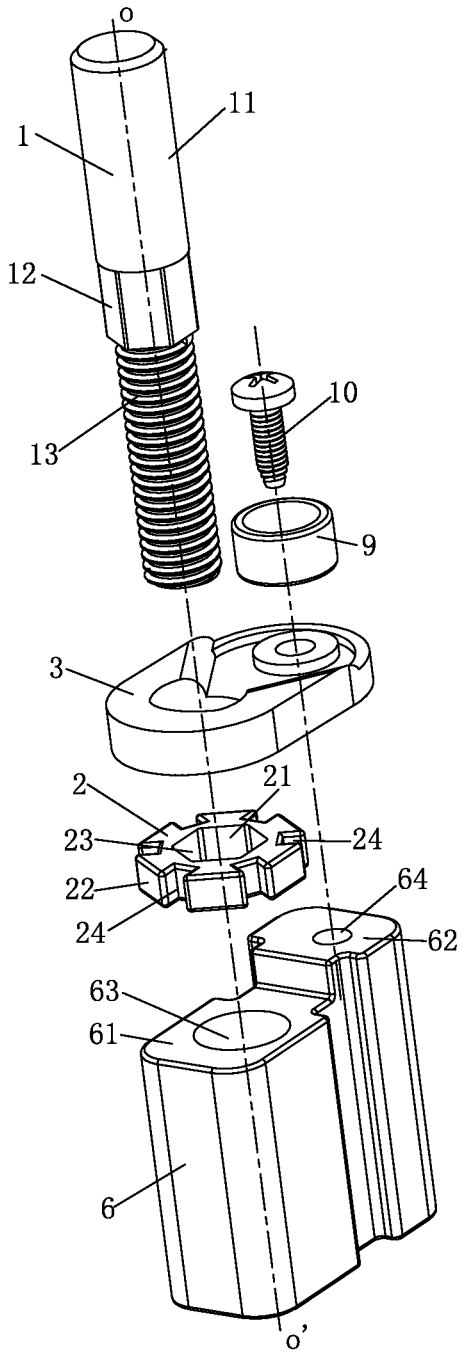
FIG. 3 is an exploded perspective view of a height adjusting mechanism according to an embodiment of the present disclosure.

As shown in FIG. 3, the hinge shaft 1 may comprise a fitting shaft portion 11, an adjusting shaft portion 12 and a connecting shaft portion 13. The fitting shaft portion 11 is pivotably fitted with the support such as, for example, a refrigerator door to be adjusted in the vertical direction, the adjusting shaft portion 12 may be mated with the adjusting member 2 so that the hinge shaft 1 may be adjusted or rotated due to the mating of the is adjusting shaft portion 12 with the adjusting member 2, and the connecting shaft portion 13 is threadedly fitted with the base 4, so that when the adjusting member 2 is driving the adjusting shaft portion 12 to rotate, the hinge shaft 1 is liftable in the axial direction thereof due to the threading connection of the connecting shaft portion 13 with the base 4. The adjusting shaft portion 12 may be of a polygonal shape such as a hexagonal shape, and the connecting shaft portion 13 may be formed with threads. The connecting shaft portion 13 may be disposed in the lower part of the hinge shaft 1, the adjusting shaft portion 12 may be disposed in a middle part of the hinge shaft 1, and the fitting shaft portion 11 may be disposed in an upper part of the hinge shaft 1 to be fitted with the support (not shown).

A center 21 of the adjusting member 2 may be formed with an adjusting aperture 23 which is of a polygonal shape, and the adjusting shaft portion 12 has a cross section perpendicular to the axis OO' mated with the polygonal shape, which is configured to be running fitted with the adjusting aperture 23. The adjusting member 2 has a cross section perpendicular to the axis OO' with a polygonal periphery 22. Further, the peripheral surface of the adjusting member 2 may be formed with adjusting grooves 24 which are extended in the axial direction, which is so-called screwdriver grooves. Alternatively, there are one or more adjusting grooves 24 with an I-beam shape.

Figure 4:
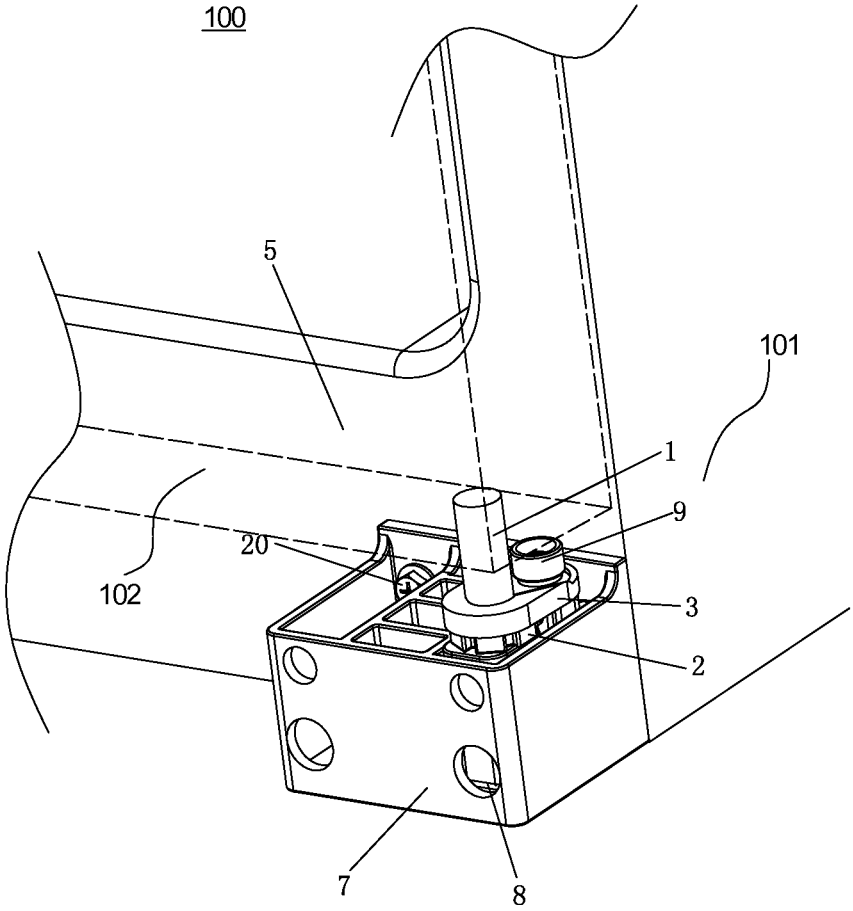
FIG. 4 is a partial schematic view of a refrigerator according to an embodiment of the present disclosure.
Figure 5:
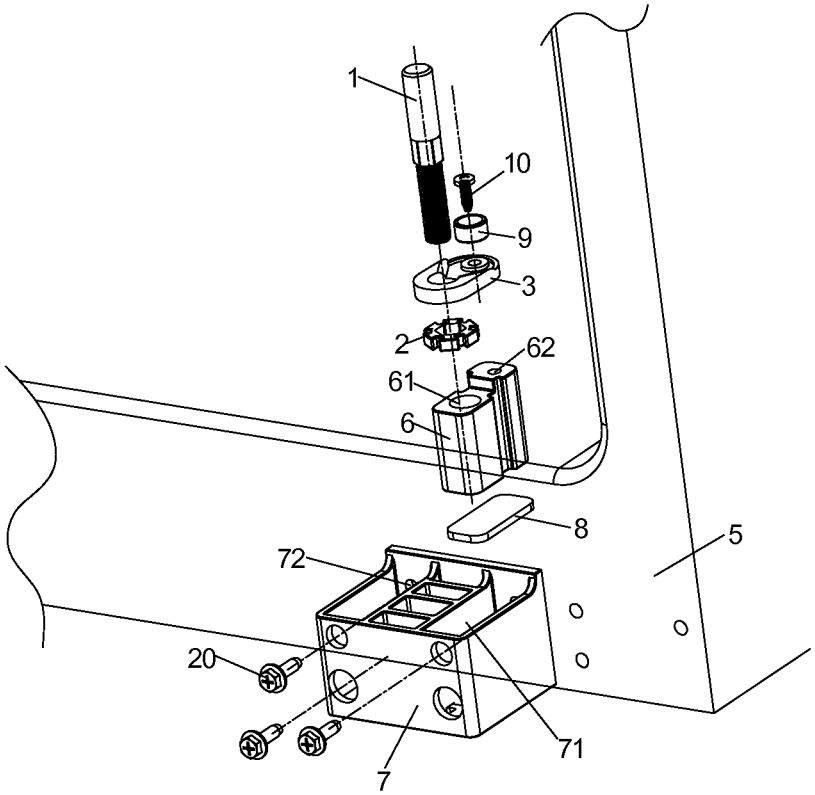
FIG. 5 is a schematic view of a refrigerator according to another embodiment of the present disclosure.

The base 4 may comprise a supporting base part 6 and a hinge base part 7, in which the hinge shaft 1 is liftably connected to the supporting base part 6, and the supporting base part 6 is detachably received in the hinge base part 7. Particularly, the supporting base part 6 supports the hinge shaft 1 and is threadedly fitted with the hinge shaft 1. The supporting base part 6 has an end, facing toward the adjusting member 2, being formed into a stepped part, the stepped part has a first surface 61 and a second surface 62 higher than the first surface 61 in the axial direction OO'. As shown in FIGS. 2 and 3, the adjusting member 2 is disposed on the first surface 61 and the constraining member 3 is detachably connected to the second surface 62, and the adjusting member 2 is disposed between the first surface 61 and the constraining member 3. Particularly, the supporting base part 6 is formed with a first hole 63 penetrating through the supporting base part 6 from the first surface 61 and a second hole 64 from the second surface 62. The first hole 63 may be formed into a threaded hole. The second hole 64 may also be a threaded hole. The hinge base part 7 may have an accommodating cavity 71 and a plurality of fixing holes 72 for fixing to a stationary member such as, for example, a main body of a refrigerator etc. The adjusting member 2 may have a height identical to a height difference between the first surface 61 and the second surface 62 in the axial direction OO' of the hinge shaft 1. Alternatively, the supporting base part 6 may be threadedly fitted with the hinge shaft 1 in advance to form an integral assembly, which is disposed on the is hinge base part 7. Therefore, only the hinge base part 7 may need to be fixed, thus improving the mounting efficiency thereof. Moreover, because only the hinge base part 7 needs to be fixed, the fixing holes 72 may be circular holes, thus improving the mounting consistency and, in turn, the overall strength of the hinge base part 7. Therefore, the mounting may be much more stable compared with a conventional one. In another example, the supporting base part 6 and the hinge base part 7 may be integrally formed. The height adjusting mechanism may also comprise a bottom plate 8, a spacing member 9 and a bolt 10. The bottom plate 8 is disposed between a bottom surface of the supporting base part 6 and the hinge base part 7. The bottom plate 8 may distribute the pressure applied to the base 4 by the hinge shaft 1 during the adjusting process, thus preventing the hinge shaft 1 from directly impacting the hinge base part 7 to damage the height adjusting mechanism inadvertently. The spacing member 9 is disposed on the constraining member 3, and the spacing member 9 and the constraining member 3 are fixed on the second surface 62 of the supporting base portion 6 via a fastener such as a bolt 10 shown in FIG. 5. As shown in FIG. 4, when the support such as the refrigerator door 102 shown in dashed line in FIG. 4 is mounted onto the fitting shaft portion 11, the position of the support may be constrained by the spacing member 9. It should be noted that the height of the spacing member 9 may be predetermined or pre-calculated to meet certain industrial requirements accordingly.

During assembly, the adjusting member 2 is disposed on the first surface 61 of the supporting base part 6. The constraining member 3 is disposed on the second surface 62 of the supporting base part 6, and the adjusting member 2 is disposed between the first surface 61 and the constraining member 3. After passing through the constraining member 3 and the adjusting member 2 from the top down, the hinge shaft 1 passes through the first hole 63 of the supporting base part 6 and is threadedly fitted with the first hole 63. The polygonal adjusting aperture 23 of the adjusting member 2 is running fitted with the polygonal adjusting shaft portion 12 of the hinge shaft 1. The constraining member 3 is disposed on the spacing member 9, and the bolt 10 passes through the spacing member 9 and the constraining member 3 into the second hole 64 of the supporting base part 6 to fix the spacing member 9 and the constraining member 3 on the second surface 62 of the supporting base part 6. The bottom plate 8 is disposed in the accommodating cavity 71 of the hinge base part 7, the supporting base part 6 is also disposed on the bottom plate 8 in the accommodating cavity 71, and the hinge shaft 1 is disposed above the bottom plate 8. The constraining member 3 may constrain the movement of the adjusting member 2 in the axial direction of the hinge shaft 1, so that the adjusting member 2 may not ascend or descend with the hinge shaft 1 when driving the is hinge shaft 1 to rotate.

The hinge shaft 1 of the height adjusting mechanism may be connected with the support. The hinge base part 7 may be fixed on a fixing base 5, for example, via a threaded fastener. When the adjusting member 2 is rotated by a rotating member such as, for example, wrench, the hinge shaft 1 may ascend or descend relative to the fixing base 5 so that the support may be adjusted easily.

When the support needs to be adjusted, the adjusting member 2 is rotated by hand or a tool such as, for example, a wrench, to cause the hinge shaft 1 to ascend or descend, so that a gap between the hinge shaft 1 and the bottom plate 8 may increase or decrease accordingly. Because the position of the bottom plate 8 is fixed, the hinge shaft 1 may ascend or descend with the support.

For the height adjusting mechanism, when the adjusting member 2 is rotated, the hinge shaft 1 may ascend or descend, so that the support supported by the hinge shaft 1 may ascend or descend at the same time. In the case that the support is directly fixed on the hinge shaft 1, the spacing member 9 may not need to be provided. The support may also be rotatably supported by the hinge shaft 1, that is, the support is supported by the hinge shaft 1 and may be rotated relative to the hinge shaft 1. The adjusting member 2 may be rotated by hand or a tool. When the adjusting member 2 is rotated by a tool such as a wrench, the adjusting member 2 may have a polygonal periphery such as a hexagonal periphery mated with the tool, so that a commonly used Allen wrench may be used to adjust the adjusting member 2. The adjusting member 2 may also be formed with adjusting grooves of an I-beam shape, so that commonly used screwdrivers of an I shaped tip may be used. Certainly, the adjusting member 2 may also be formed with both the polygonal periphery and the adjusting grooves of an I shape. Alternatively, the adjusting member 2 may drive the hinge shaft 1 to rotate by fitting the polygonal adjusting aperture 23 with the polygonal adjusting shaft portion 12. Alternatively, the adjusting member 2 may drive the hinge shaft 1 to rotate by a plurality of protrusions and a plurality of grooves which are mated with each other. The adjusting member 2 may drive the hinge shaft 1 to rotate in other manners in which synchronous rotation of the hinge shaft 1 and the adjusting member 2 may be achieved. The base 4 may comprise the supporting base part 6 and the hinge base part 7 which are disposed separately. In one embodiment, the hinge shaft 1 may be threadedly connected with the supporting base part 6 in advance to form an integral assembly. When the height adjusting mechanism is mounted, only the integral assembly needs to be disposed on the hinge base part 7. Therefore, only the hinge base part 7 may need to be fixed, thus improving the mounting efficiency. The supporting base part 6 and the hinge base part 7 may also be integrally connected with is each other to form an assembly.

In order to prevent the hinge shaft 1 from directly impacting the hinge base part 7 during the descending process to damage the hinge shaft 1, the height adjusting mechanism may also comprise a bottom plate 8 disposed below the hinge shaft 1. The bottom plate 8 may distribute the pressure applied to the base 4 by the hinge shaft 1.

According to another aspect of the present disclosure, as shown in FIG. 4, a refrigerator 100 may also provided. The refrigerator 100 may comprise: a main body 101 with a chamber (not shown) being defined therein for receiving items to be refrigerated or cooled; a door 102 which is pivotably connected to the main body 101 for opening/closing the chamber; and the above mentioned height adjusting mechanism, in which the base 4 of the height adjusting mechanism is detachably connected to the main body 101, and a lower end of the door 102 is pivotably fitted with the hinge shaft 1 of the height adjusting mechanism.

Therefore, when the height adjusting mechanism is used in the refrigerator 100, the hinge shaft 1 of the height adjusting mechanism is pivotably connected with the door 102 of the refrigerator 100, and the hinge base part 7 of the height adjusting mechanism is fixed on the main body 101 of the refrigerator 100 via fasteners 20 which pass through fixing holes 72 of the hinge base part 7 and is fixed on the main body 101 of the refrigerator 100. The main body 101 is the above mentioned fixing base 5. The rotation angle and the height of the door 102 may be constrained by the spacing member 9. In one embodiment, when the height adjusting mechanism is used in a side by side combination refrigerator having two doors disposed side by side, the two doors may be aligned by the height adjusting mechanism at either side. Certainly, the height adjusting mechanism may also be used in other devices in which the height of a support, such as a plate or a door etc., may need to be adjusted.

Reference throughout this specification to "an embodiment", "some embodiments", "one embodiment", "an example", "a specific examples", or "some examples" means that a particular feature, structure, material, or characteristic described in connection with the embodiment or example is included in at least one embodiment or example of the disclosure. Thus, the appearances of the phrases such as "in some embodiments", "in one embodiment", "in an embodiment", "an example", "a specific examples", or "some examples" in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from spirit and principles of the disclosure. Such changes, alternatives, and modifications all fall into the scope of the claims and their equivalents.

What is claimed is:

1. A height adjusting mechanism, comprising:

a hinge shaft;

an adjusting member for driving the hinge shaft to rotate around an axis of the hinge shaft;

a constraining member for constraining a movement of the adjusting member in an axial direction of the hinge shaft; and a base with the constraining member fixedly connected thereto, wherein the hinge shaft connected with the base is liftable in the axial direction of the hinge shaft under the driving of the adjusting member, the base comprises:

a supporting base part to which the hinge shaft is liftably connected; and a hinge base part in which the supporting base part is detachably accommodated, the hinge shaft comprises:

a fitting shaft portion;

an adjusting shaft portion connected to the fitting shaft portion which is mated with the adjusting number so as to adjust the hinge shaft; and a connecting shaft portion which is threadedly connected to the base;

a center of the adjusting member is formed with an adjusting aperture which is of a polygonal shape at the center thereof, and the adjusting shaft portion has a cross section perpendicular to the axis mated with the polygonal shape, which is configured to be running fitted with the adjusting aperture;

the adjusting member has a cross section perpendicular to the axis with a polygonal periphery;

the peripheral surface of the adjusting member is formed with adjusting grooves which are extended in the axial direction; and the supporting base part has an end facing toward the adjusting member being formed into a stepped part having a first surface and a second surface higher than the first surface in the axial direction, with the adjusting member being disposed on the first surface and the constraining member being detachably connected to the second surface and the adjusting member being disposed between the first surface and the constraining member.

2. The height adjusting mechanism according to claim 1, wherein the hinge shaft is threadedly connected to the base.

3. The height adjusting mechanism according to claim 1, further comprising:

a bottom plate disposed between a bottom surface of the supporting base part and the hinge base part.

4. The height adjusting mechanism according to claim 1, further comprising:

a spacing member disposed on the constraining member, with the spacing member and the constraining member being fixed on the second surface of the supporting base portion via a fastener.

5. A refrigerator, comprising:

a main body with a chamber being defined therein;

a door which is pivotably connected to the main body for opening/closing the chamber; and a height adjusting mechanism according to claim 1, wherein the base of the height adjusting mechanism is detachably connected to the main body, and a lower end of the door is pivotably fitted with the hinge shaft of the height adjusting mechanism.

* * * * *